US005237978A

United States Patent [19]

Bailey

[11] Patent Number: 5,237,978

[45] Date of Patent: Aug. 24, 1993

[54] APPARATUS FOR MULTI-FUEL SYSTEM OF AN ENGINE

[75] Inventor: John M. Bailey, Dunlap, Ill.

[73] Assignee: Caterpillar Inc., Peoria, Ill.

[21] Appl. No.: 952,007

[22] Filed: Sep. 28, 1992

[51] Int. Cl.[5] ..... F02M 43/00

[52] U.S. Cl. ..... 123/515; 123/575; 123/456; 123/514

[58] Field of Search ..... 123/514, 515, 1 A, 494, 123/575, 557, 510, 456

[56] References Cited

U.S. PATENT DOCUMENTS

| | | | |
|---|---|---|---|
| 4,393,854 | 7/1983 | Tacquet | 123/514 |
| 4,404,944 | 9/1983 | Yamazaki | 123/458 |
| 4,413,604 | 11/1983 | Tone | 123/575 |
| 4,471,744 | 9/1984 | Holtz | 123/575 |
| 4,524,744 | 6/1985 | Adams | 123/514 |
| 4,594,201 | 6/1986 | Phillips et al. | 261/18 B |
| 4,625,701 | 12/1986 | Bartlett et al. | 123/516 |
| 4,683,864 | 8/1987 | Bucci | 123/575 |
| 4,732,131 | 3/1988 | Hensel | 123/514 |
| 4,922,862 | 5/1990 | Casacci | 123/1 A |
| 4,926,829 | 5/1990 | Tuckey | 123/514 |
| 4,989,568 | 2/1991 | Sougawa | 123/456 |

FOREIGN PATENT DOCUMENTS

| | | | |
|---|---|---|---|
| 0200050 | 11/1983 | Japan | 123/515 |

*Primary Examiner*—E. Rollins Cross
*Assistant Examiner*—Erick Solis
*Attorney, Agent, or Firm*—Frank L. Hart

[57] ABSTRACT

An apparatus for a multi-fuel system has a recirculation conduit passing excess fuel back to a mixing chamber where it is mixed with incoming fuel and thereby preventing abrupt fuel composition changes associated with switching from one fuel to another.

2 Claims, 2 Drawing Sheets

APPARATUS FOR MULTI-FUEL SYSTEM OF AN ENGINE

TECHNICAL FIELD

This invention relates generally to apparatus for controlling detrimental effects of switching from one fuel to another in a multi-fuel system of an engine.

BACKGROUND ART

In the operation of multi-fuel systems for engines, it is necessary to identify the fuel being used and then appropriately change the volume of fuel entering the combustion chambers and the timing of the engine. Examples of such systems are set forth in Oliver Phillips U.S. Pat. No. 4,594,201 which issued Jun. 10, 1986 and Carlo Casacci U.S. Pat. No. 4,922,862 which issued May 8, 1990.

Spark ignition Otto cycle "Flexible-fueled" or "Variable-fueled" engines use a sensor to identify the fuel type along with the well known closed-loop system which senses the oxygen content of the engine exhaust to maintain a desired fuel/air ratio for the engine. Given an accurate and stable sensor for determining the characteristics of the fuel being used at any instant, it is a reasonably simple matter to control the carburetor or other means which might be used for introducing the fuel into the inlet air, even if the fuel characteristics vary rapidly during operation due to incomplete mixing in the fuel tank.

The problems are much greater when attempting to provide similar automatic control of a multi-fuel or flexible-fueled diesel cycle engine as is the subject of this invention. In this type of engine, certain characteristics of the fuel being delivered from the tank which will provide an indication of the fuel volumetric energy content must also be automatically sensed by a suitable fast acting sensor because the fuel characteristics may change rapidly due to incomplete mixing of two fuels, such as methanol and diesel fuel, in the fuel tank or when changing over from one fuel to another if two fuel tanks are used. Signals from the sensor are delivered to the engine control system. In addition, the fuel is injected at high pressures using a separate fuel pump for each cylinder which can thus be spaced apart as much as the length of the engine but which must each inject about the same amount of fuel energy at the correct time in the engine cycle. Consequently, means must be provided to assure that each of the high pressure pumps are fed with fuel having essentially the same characteristics at any given time.

The present invention is directed to overcoming one or more of the problems as set forth above.

DISCLOSURE OF THE INVENTION

In one aspect of the present invention, a fuel injection system is provided for multi-fuel systems. These systems have a plurality of fuel metering members each associated with a respective combustion chamber of an engine and each metering member is connected in fluid communication with a fuel header having an inlet and an outlet. A mixing chamber is connected in fluid communication with the inlet of the fuel header. A recirculating conduit is connected in fluid communication at one end with the outlet of the header and at the other end to the mixing chamber.

BEST MODE FOR CARRYING OUT THE INVENTION

Figure 1:
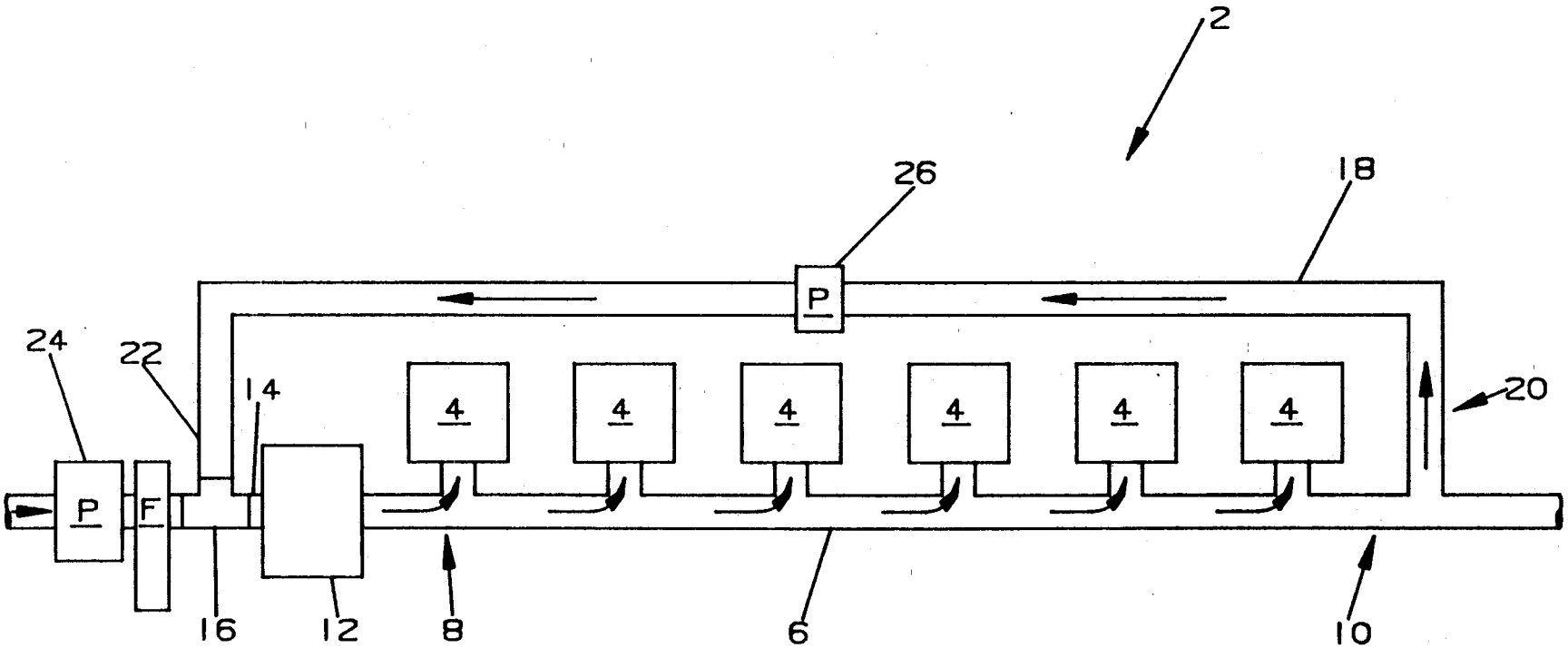
FIG. 1 is a diagrammatic view of the elements of this invention.

Referring to FIG. 1, apparatus 2 is provided for a fuel system (not shown) which is capable of using two or more different kinds of fuel for operating an engine (not shown). One examples of such fuel systems would be one having a tank for methanol fuel and a separate tank for diesel fuel with means, as well known in the art, for switching from one fuel to another during operation of the engine.

Such a system has a plurality of fuel metering members (each designated by the number 4) and each being associated with a respective combustion chamber of an engine (not shown). Each metering member 4, as is well known in the art, is connected in fluid communication with a fuel header 6 which has an inlet portion 8 and an outlet portion 10, which outlet portion is generally connected to the supply tank (not shown).

A sensor (12) has an inlet (14). The sensor is connected to the inlet 8 of the fuel header 6. The sensor is adapted to receive and sense preselected properties of a fuel and deliver a signal in response thereto. A mixing chamber 16 is connected in fluid communication with the inlet 8 of the fuel header 6 and with a recirculation conduit 18.

The recirculation conduit 18 has first and second ends 20,22. The first end of the conduit 18 is connected to the header outlet 10 and, as set forth above, the second end 22 is connected to the mixing chamber 16.

Means 24,26, such as pump for example, are connected to the mixing chamber 16 and the recirculating conduit 18 for pressuring and passing fuel into and through the mixing chamber 16.

The sensor 12 is connected in fluid communication to the fuel header 6 and adapted to recover a sample of fuel passing through the header 6. In an example embodiment of a multi fuel system, the analyzing portion of the sensor 12 is adapted to burn the sample with a constant mass flow rate of air at stoichiometric conditions and measure the volumetric flow rate of the sample during said burning. This volumetric flow rate is delivered as a signal to an engine controller (not shown) for controlling the fuel injection volume and timing. Engine controllers are well known in the art and are not a part of this invention.

Figure 2:
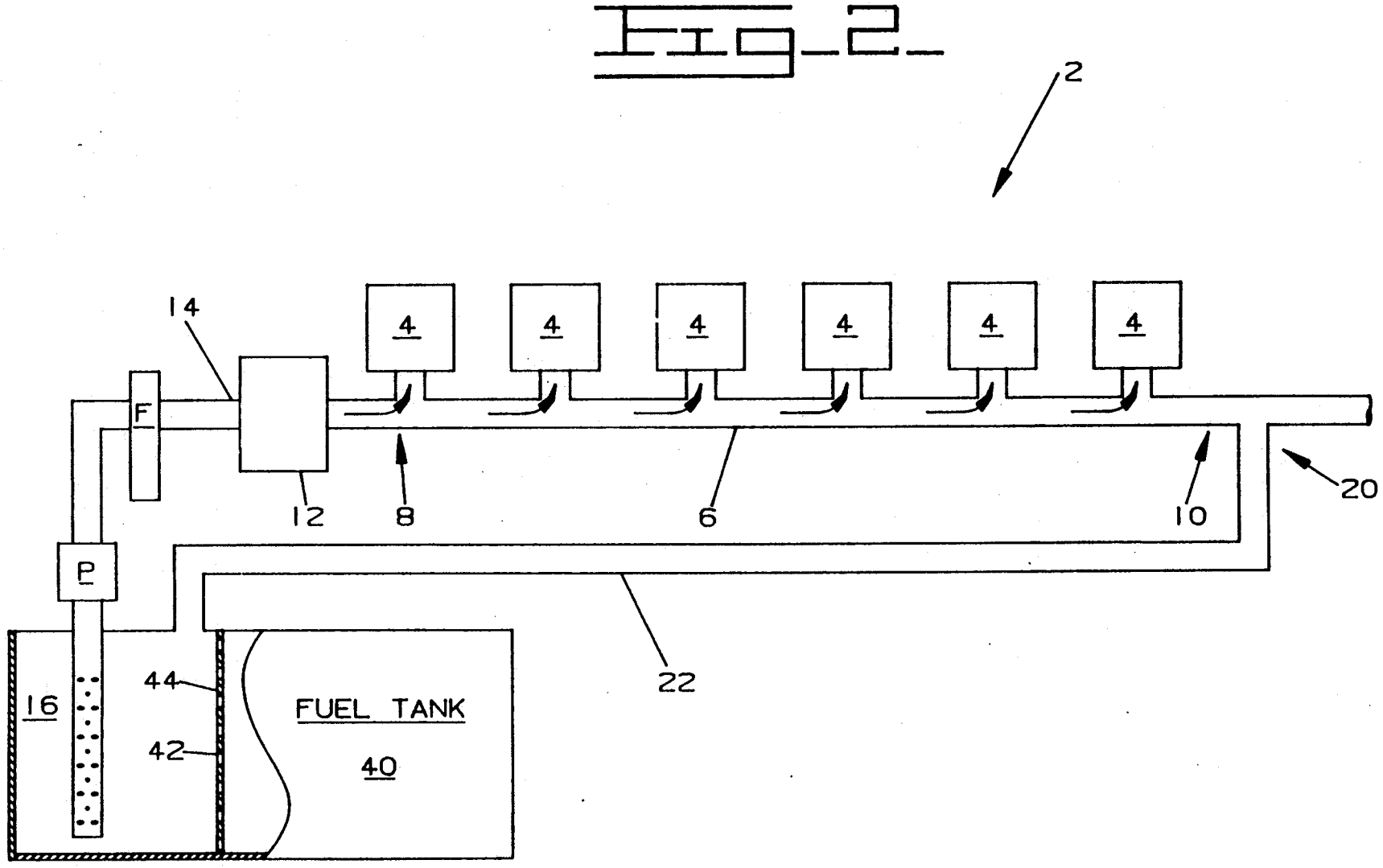
FIG. 2 is a diagrammatic view of another embodiment of this invention.

FIG. 2 shows another embodiment of the apparatus of this invention wherein the mixing chamber 16 is associated with the fuel tank 40. In this embodiment, fuel passes through openings 42 of the barrier 44 of the tank 40 and into the mixing chamber 16. In this embodiment, the pump 26 of the embodiment of FIG. 1 is eliminated and the mixing chamber 16 is associated with a portion of the fuel tank 40. This embodiment is particularly useful where the fuel system uses two liquid immiscible fuels from a single tank 40.

Industrial Applicability

In the operation of the apparatus of this invention, fuel is pressurized and passed to the mixing chamber 16 and there mixed with fuel recirculating from the outlet end 10 of the header 6. A portion of the mixture exiting from the mixing chamber 16 is passed into the engine for combustion and another larger portion is recirculated back to the mixing chamber 16 and there mixed with incoming fuel.

In order to prevent sharp changes in the properties of combustion of the fuel passing into the combustion chamber associated with switching from one fuel to another, it is important that the volume of recirculating fuel be large relative to the amount of fuel being delivered to the cumulative fuel metering members 4 of the engine. An example of the ratio of flow rates that can be used is 10:1 at maximum power of the engine. Since the pressure in the header is only about 50 psig, for example, the large flow rate of fluid through the recirculating conduit 18 can easily be boosted by the recirculating pump 26 to a magnitude sufficient to enter the mixing chamber without utilizing large amounts of energy.

A fuel sample is recovered from the fuel header and preselected properties of the fuel sample are measured. A signal is delivered in response to the measured property and the engine is controlled in response to that signal.

Examples of preselected properties of the fluid sample which can be utilized in practicing the instant invention for controlling the timing and volume of fuel injected into the combustion chamber are combustion characteristics, index of refraction, and dielectric constant.

Other aspects, objects and advantages of this invention can be obtained from a study of the drawings, the disclosure and the appended claims.

I claim:

1. In a fuel injection system of a multi-fuel system having a plurality of fuel metering members each associated with a respective combustion chamber of an engine with the metering members being connected in fluid communication with a fuel tank and a fuel header having an inlet and an outlet, the improvement comprising:

a mixing chamber connected in fluid communication with the inlet of the fuel header; and a recirculation conduit having first and second ends and being connected to one end in fluid communication with the outlet of the header and at the other end to the mixing chamber, said system being of a construction sufficient to deliver fluid through the recirculation conduit at a rate at least 10 times the cumulative rate of flow into the metering members of the engine at maximum flow rate into said metering members.

2. An apparatus, as set forth in claim 1, including means for pressurizing recirculating fuel passing through the recirculation conduit.

* * * * *